United States Patent [19]

Fritsch

[11] 3,974,714

[45] Aug. 17, 1976

[54] PUMP DRIVING MECHANISM WITH ADJUSTABLE STROKE

[75] Inventor: Horst Fritsch, Leonberg, Germany

[73] Assignee: LEWA Herbert Ott Kommanditgesellschaft, Leonberg, near Stuttgart, Germany

[22] Filed: Nov. 21, 1974

[21] Appl. No.: 525,975

[30] Foreign Application Priority Data

Oct. 1, 1974 Germany ..... 2446806

[52] U.S. Cl. ..... 74/571 L

[51] Int. Cl.[2] ..... G05G 1/00

[58] Field of Search..... 74/571 R, 571 L, 571 M, 74/600

[56] References Cited

UNITED STATES PATENTS

| | | | |
|---|---|---|---|
| 1,189,588 | 7/1916 | Lander | 74/571 L |
| 1,977,924 | 10/1934 | Sunder | 74/571 |
| 2,503,907 | 4/1950 | Hefler | 74/571 |
| 2,521,711 | 9/1950 | Galliano | 74/571 L |
| 2,592,237 | 4/1952 | Bradley | 74/571 R |

*Primary Examiner*—Benjamin W. Wyche
*Assistant Examiner*—Wesley S. Ratliff, Jr.
*Attorney, Agent, or Firm*—Gipple & Hale

[57] ABSTRACT

A dosaging pump driving mechanism for converting the rotary motion of a driving wheel into the oscillatory motion of a piston connecting rod, which is connected at right-angles to the axle of the driving wheel, by a radially moveable eccentric. The stroke of the connecting rod adjustable by an adjustment device, which acts upon the radially movable eccentric to change its eccentricity and has a shaft, which can be moved in the axial direction of the driving wheel and of the eccentric by an adjusting-spindle. The shaft defines a slot at an incline to the shaft axis, in which a sliding member is linearly displaced in radial direction together with the eccentric.

5 Claims, 2 Drawing Figures

PUMP DRIVING MECHANISM WITH ADJUSTABLE STROKE

The invention relates to a pump driving mechanism, especially a dosaging pump driving mechanism, for converting the rotary motion of a driving wheel into the oscillatory motion of a piston connecting rod, which is situated at right-angles to the axle of the driving wheel, by means of an eccentric; the stroke of the connecting rod being adjustable by means of an adjustment device, wherein the adjustment device acts upon the radially movable eccentric to change its eccentricity.

Pump driving mechanisms of this kind are known. However, they have drawbacks in that the characteristic of the adjustment device is not linear but essentially sinusoidal. A pump driving mechanism having an adjustment device of this kind is therefore unsuitable for driving dosaging pumps, the stroke volume of which should be adjustable and linearly dependent upon a dosaging quantity. A linear relationship between the magnitude of adjustment and the stroke of the oscillating connecting rod is known for pump driving mechanisms, however, such pump driving mechanisms show drawbacks of design resulting in a large force necessary for adjustment and the pump driving mechanism not only being of costly design but also occupying a large space.

The object of the invention is to overcome these drawbacks and to provide a pump driving mechanism in which all components necessary for the transmission of the stroke-adjusting movement can be adjusted freely with respect to each other, so that fewer demands are made on the exactness of manufacture and the production cost of such a pump driving mechanism is thereby lowered. Furthermore the adjustment forces necessary for actuating the stroke-adjustment device shall be small and finally, the desired exact linear dependence of the length of stroke on the magnitude of the adjustment shall be given.

The features of the invention, which was made to achieve this object, are shown in the main claim, while advantageous developments of the invention are given in the additional claims.

With the pump driving mechanism according to the invention it is possible, by making a simple axial adjustment of the shaft by means of the spindle, to displace radially the sliding member, which is constrainably guided in the shaft-slot, and with it, the connecting rod via the eccentric in a simple and reliably functioning manner and in this way to adjust the stroke of the oscillating connecting rod movement. All components provided for the transmission of the adjusting movement can be adjusted freely with respect to each other so that few demands are made on the exactness of manufacture. In this way end pressure with undesirable consequences such as increased wear, large play, etc., is avoided even if small errors of machining occur. Apart from this, only small adjusting forces are needed for actuating the stroke-adjustment device, because the driving forces do not place a load upon, or affect the adjusting movement.

As only few components are provided which move relative to each other under load, it becomes possible to use extremely few and therefore statically satisfactory bearings, which in advantageous manner results in good overall efficiency, small total clearance and extremely quiet running of the pump driving mechanism.

Finally, the length of the stroke is of exact linear dependence upon the adjustment, because the sliding member, which is firmly joined to the eccentric, is constrainably guided between the parallel surfaces of the shaft-slot.

The invention is described in detail with the aid of the diagrams.

Figure 2:
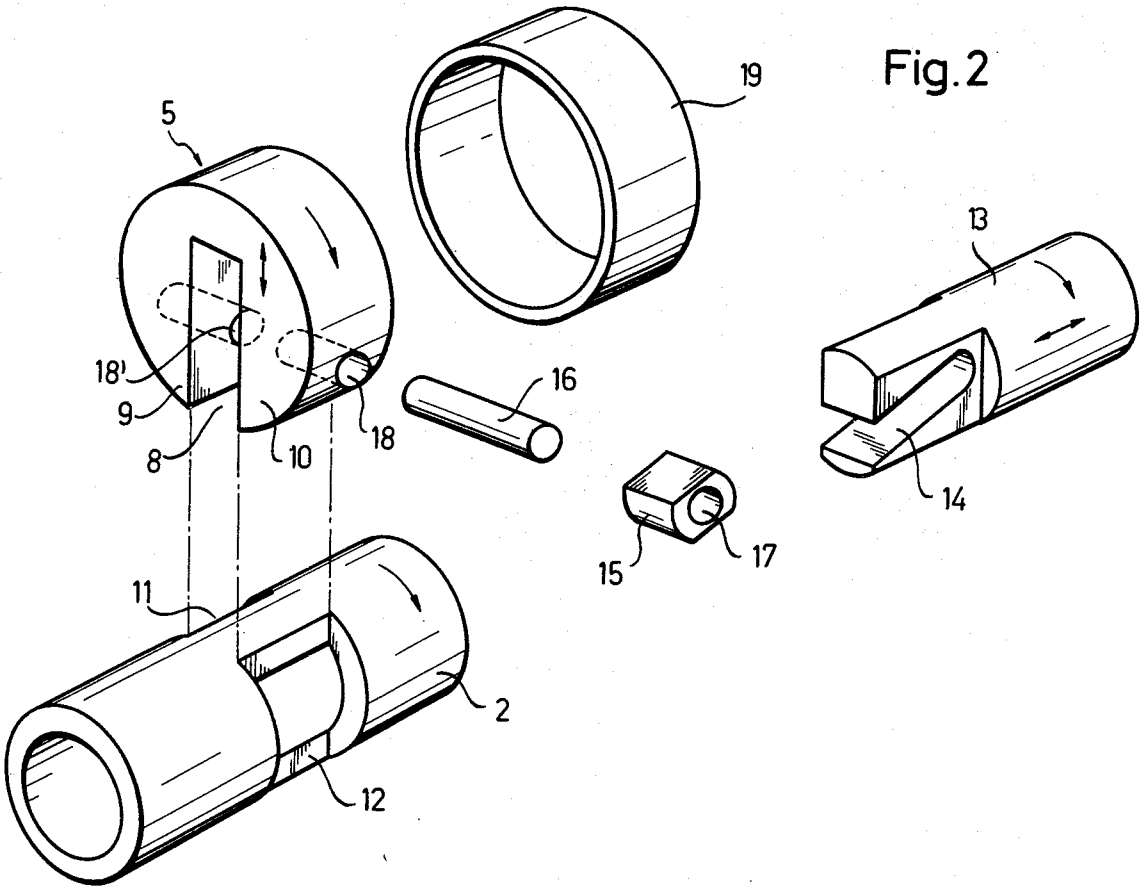
FIG. 2 shows an exploded view in perspective of the adjustment device with the eccentric.

As is seen from the figure, a hollow shaft 2, to which a worm gear 3 serving as a driving wheel is attached coaxially so as to revolve together with the hollow shaft 2, is pivoted so as to rotate freely in a casing 1. The driving wheel 3 is rotated by means of a worm wheel 4 and transmits its rotary motion via the hollow shaft 2 to an eccentric 5, which is joined to the hollow shaft 2 so as to revolve together with it and which, in the manner shown by FIG. 2, is shaped as a rotary part and serves as a rotary bearing for a connecting rod 6. The connecting rod 6 is given an oscillatory motion via the eccentric 5; this movement being derived from a crosshead joint 7 of the connecting rod 6 in the usual manner. For the purpose of linking the eccentric 5 with the hollow shaft 2, so that both revolve together, the eccentric 5 has a cut in radial direction in the shape of a slot 8, whereby two limbs 9, 10 of the eccentric 5, situated opposite to each other, are formed. By means of the limbs 9, 10 the eccentric 5 slides onto correspondingly shaped parallel surfaces 11, 12 of the hollow shaft 2 which are situated opposite to each other. In this way the eccentric 5 is joined to the hollow shaft 2 so as to revolve together with it and can also be displaced in a radial direction with respect to the hollow shaft 2.

A shaft 13 which is displaceable along the direction of the long axis of the hollow shaft 2 is guided within the hollow shaft 2. At its lower region the shaft 13 has suitably shaped parallel surfaces, which are adapted to the cut surfaces 11, 12 of the hollow shaft 2. In this lower region of the shaft 13 a slot 14 is provided running at an incline to the axis of the shaft 13 in such manner that the open and the closed end of the slot 14 are situated opposite each other with respect to the axis of the shaft 13. The parallel wall-surfaces of the slot 14 constrainably guide a sliding member 15, which has correspondingly shaped parallel side surfaces and is linked so as to revolve together with the eccentric 5. For this purpose the sliding member 15 is fitted exactly into the slot 8 of the eccentric 5 and is pivoted there by means of a bolt 16, which at the same time passes through a bore hole 17 in the sliding member 15 as well as corresponding bore holes 18, 18' in the limbs 9, 10 of the eccentric.

In order to secure the bolt 16 against undesired displacement and to attain a closed outer running surface of the eccentric 5 a ring 19 is fastened, for example by being pressed on, to the circumference of the eccentric 5.

An adjusting spindle 21 is joined to the upper end of the shaft 13 by means of a bearing 20, the shaft 13 being displaceable together with the adjusting spindle 21, yet freely rotatable with respect to the adjusting spindle 21. The adjusting spindle 21 passes through a casing-cover 22 at which the upper end of the hollow shaft 2 is pivoted so as to be freely rotatable in a manner evident from FIG. 1 and is joined to an adjusting nut 23, so as to revolve together with it. The adjusting nut is shaped as a hand wheel and can be wound in and out of an opening 24 in the casing cover 22 which is provided with an inside thread.

When the driving mechanism is operated, as has already been explained, the worm gear 3 serving as driving wheel is rotated via the worm wheel 4. Because of being linked so as to revolve together, the hollow shaft 2, the eccentric 5, the bolt 16, the sliding member 15 and the shaft 13 also rotate. Because of the eccentricity of the rotating eccentric 5 the connecting rod 6 is set into oscillatory motion, which is transmitted to the piston rod of the piston or displacement piston of a piston or membrane pump, which has not been shown.

Figure 1:
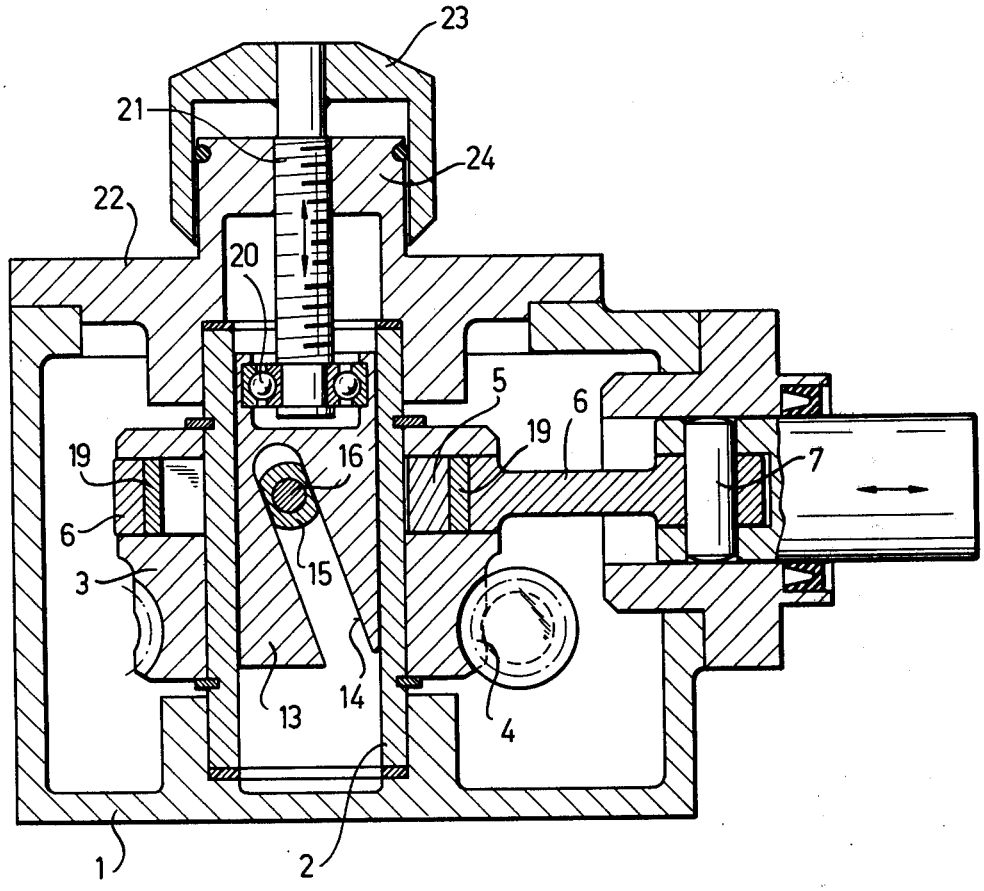
FIG. 1 shows a longitudinal cross-section of the pump driving mechanism.

If the stroke of the oscillatory movement of the connecting rod 6 is to be altered, it is merely necessary to move the adjusting spindle 21 and with it the shaft 13 upwards or downwards in axial direction of the hollow shaft 13 by turning the adjusting nut 23. In this way the slot 14 of the shaft 13 is displaced in corresponding manner, so that the sliding member 15, which is guided in the slot 14, is of necessity displaced to the right or the left as seen in FIG. 1. Because the sliding member 15 is linked to the eccentric 5 so as to revolve together with it, the eccentric 5 is thereby also displaced to the right or the left as seen in FIG. 1, so that its eccentricity is changed in the manner required. The adjustment can be made during operation as well as during rest of the driving mechanism. An exact linear relationship between the magnitude of the adjustment made and the stroke is ensured in any case.

I claim:

1. A pump drive mechanism, such as a metering pump drive mechanism, designed to effect the transformation of the rotary motion of a drive wheel into an oscillating movement of a connecting rod, arranged at a right angle to the axis of the drive wheel comprising an eccentric disc mounted on said drive wheel; the stroke of the connecting rod being adjustable across the eccentric disc and positioned so as to be radially displaceable by control means adjusting the eccentricity of the eccentric disc, said radially moveable eccentric disc being mounted to a hollow shaft carrying a control shaft so that the eccentric disc and the hollow shaft cannot spin apart, said hollow shaft being only rotateably moveable in the housing of the drive mechanism and mounted to it bearing the drive wheel, said control means comprising a control shaft which can be coaxially moved to the drive wheel as well as to the eccentric disc by means of a control spindle connected thereto and a control element mounted to said eccentric disc and moving in an oblique slot defined in said control shaft obliquely inclined to the shaft axis; said control element shifting the eccentric disc radially/linearly upon axial displacement of the control shaft.

2. A pump drive mechanism according to claim 1, wherein the eccentric disc moves along its shanks which are formed by a radial slot onto the correspondingly shaped parallel and diametrically opposed channelled surfaces defined in the hollow shaft.

3. A pump drive mechanism according to claim 2, wherein said central element moving in the oblique slot of the control shaft is positioned within a shaft formed in the eccentric disc by means of a bolt which runs through the control element and both shanks of the eccentric disc slot.

4. A pump drive mechanism according to claim 3, wherein a ring is pressed over the said eccentric disc to stabilize said bolt against shifting and to achieve a solid eccentric bearing surface.

5. A pump drive mechanism such as a metering pump drive mechanism designed to effect the transmission of the rotary motion of a drive wheel into the oscillating movement of a connecting rod which is arranged at a right angle to the axis of the drive wheel, comprising a pump drive housing, a hollow shaft rotatably mounted in said housing and connected to said drive wheel, a radially moveable eccentric disc mounted around said hollow shaft, a control means mounted in said hollow shaft and axially moveable therein, said control means comprising a control shaft, spindle means connected to said control shaft and threadably engaging said housing adapted to move said control shaft axially along said hollow shaft, said control shaft defining an oblique inclined groove, a control element mounted to said eccentric disc and positioned in said oblique groove so that when said control spindle is moved said drive shaft is axially moved within said hollow shaft causing said control element to be obliquely inclined in said oblique groove so that the eccentric disc upon which said control element is mounted is shifted radially/ lineraly upon the axial displacement of the control shaft to adjust the stroke of the connecting rod.

* * * * *